US007095393B2

(12) United States Patent
Lee

(10) Patent No.: US 7,095,393 B2
(45) Date of Patent: Aug. 22, 2006

(54) LIQUID CRYSTAL DISPLAY AND A DRIVING METHOD THEREOF

(75) Inventor: Baek-Woon Lee, Seongnam (KR)

(73) Assignee: Samsung Electronics Co., Ltd., (KR)

( * ) Notice: Subject to any disclaimer, the term of this patent is extended or adjusted under 35 U.S.C. 154(b) by 185 days.

(21) Appl. No.: 10/223,641

(22) Filed: Aug. 19, 2002

(65) Prior Publication Data

US 2003/0098839 A1 May 29, 2003

(30) Foreign Application Priority Data

Nov. 26, 2001 (KR) ..... 2001-73914

(51) Int. Cl.
*G09G 3/36* (2006.01)
*G09G 5/02* (2006.01)

(52) U.S. Cl. ..... 345/89; 345/204; 345/596; 345/600

(58) Field of Classification Search ..... 345/87–92, 345/690, 204, 596, 601, 602
See application file for complete search history.

(56) References Cited

U.S. PATENT DOCUMENTS

| | | | | |
|---|---|---|---|---|
| 5,010,326 | A | 4/1991 | Yamazaki et al. | 340/784 |
| 5,093,655 | A | 3/1992 | Tanioka et al. | 340/784 |
| 5,495,265 | A * | 2/1996 | Hartman et al. | 345/87 |
| 6,278,496 | B1 * | 8/2001 | Kitagawa et al. | 348/674 |
| 6,304,254 | B1 * | 10/2001 | Johnson et al. | 345/204 |
| 6,359,663 | B1 * | 3/2002 | Gadeyne et al. | 348/790 |
| 6,624,800 | B1 * | 9/2003 | Hughes et al. | 345/88 |
| 6,707,439 | B1 * | 3/2004 | Ijima et al. | 345/87 |
| 6,816,142 | B1 * | 11/2004 | Oda et al. | 345/89 |
| 2001/0043183 | A1 * | 11/2001 | Ishikawa et al. | 345/89 |
| 2004/0027322 | A1 * | 2/2004 | Chen et al | 345/89 |

FOREIGN PATENT DOCUMENTS

| | | |
|---|---|---|
| EP | 0 633 516 B1 | 10/1999 |
| EP | 0 951 007 A1 | 10/1999 |
| EP | 1 150 271 A2 | 10/2001 |
| WO | WO 94/09475 | 4/1994 |
| WO | WO 94/23415 | 10/1994 |
| WO | WO 00/57364 | 9/2000 |
| WO | WO 01/73742 A1 | 10/2001 |

OTHER PUBLICATIONS

European Patent Office; Communication pursuant to Article 96(2) EPC dated Apr. 1, 2006.
PCT International Preliminary Amendment for International Application No.: PCT/KR2002/001790; International filing date: Sep. 19, 2002; Priority date : Nov. 26, 2001; Date of Mailing : Mar. 16, 2004.
PCT International Search Report for International Application No. PCT/KR02/01790; International Filing date: Sep. 19, 2002; Priority date: Nov. 26, 2001; Date of Mailing International Search Report: Mar. 26, 2003.

* cited by examiner

*Primary Examiner*—Henry N. Tran
(74) *Attorney, Agent, or Firm*—Cantor Colburn LLP

(57) ABSTRACT

Disclosed is an LCD and driving method thereof. The LCD according to the present invention generates modification image signals by considering image signals of present and previous frames, and then supplies data voltages corresponding to the generated modification image signals to the data lines. At this time, the value for modifying the present frame image signal varies according to a modification parameter that is at least one among a temperature, an image quality selected by a user, and an environment of the LCD.

20 Claims, 7 Drawing Sheets

FIG.6

| $G_n$ \ $G_{n-1}$ | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 16 | 22 | 16 | 8 | 2 | 0 | 0 | 0 | 0 | 0 | 0 | 0 | 0 | 0 | 0 | 0 | 0 | 0 |
| 32 | 44 | 40 | 32 | 25 | 18 | 6 | 0 | 0 | 0 | 0 | 0 | 0 | 0 | 0 | 0 | 0 | 0 |
| 48 | 66 | 61 | 56 | 48 | 40 | 28 | 16 | 2 | 0 | 0 | 0 | 0 | 0 | 0 | 0 | 0 | 0 |
| 64 | 80 | 77 | 74 | 69 | 64 | 52 | 38 | 28 | 18 | 6 | 0 | 0 | 0 | 0 | 0 | 0 | 0 |
| 80 | 106 | 102 | 98 | 93 | 88 | 80 | 72 | 64 | 58 | 49 | 40 | 28 | 12 | 0 | 0 | 0 | 0 |
| 96 | 144 | 136 | 128 | 122 | 116 | 106 | 96 | 88 | 82 | 77 | 72 | 64 | 48 | 38 | 32 | 12 | 0 |
| 112 | 160 | 157 | 154 | 149 | 144 | 136 | 122 | 112 | 105 | 99 | 94 | 84 | 76 | 68 | 60 | 44 | 4 |
| 128 | 174 | 172 | 170 | 166 | 162 | 154 | 146 | 137 | 128 | 118 | 112 | 104 | 96 | 88 | 80 | 68 | 36 |
| 144 | 188 | 185 | 183 | 180 | 178 | 170 | 164 | 157 | 150 | 144 | 136 | 124 | 112 | 104 | 96 | 80 | 64 |
| 160 | 198 | 196 | 194 | 192 | 190 | 186 | 182 | 177 | 172 | 166 | 160 | 152 | 142 | 134 | 120 | 108 | 84 |
| 176 | 216 | 214 | 212 | 210 | 208 | 202 | 194 | 192 | 190 | 186 | 182 | 176 | 138 | 160 | 154 | 142 | 108 |
| 192 | 234 | 233 | 232 | 230 | 228 | 225 | 222 | 218 | 214 | 211 | 208 | 202 | 192 | 191 | 188 | 182 | 164 |
| 208 | 244 | 243 | 242 | 241 | 240 | 237 | 234 | 232 | 230 | 227 | 224 | 220 | 214 | 208 | 202 | 194 | 184 |
| 224 | 249 | 248 | 248 | 247 | 246 | 245 | 244 | 243 | 242 | 241 | 240 | 236 | 232 | 228 | 224 | 220 | 206 |
| 240 | 253 | 253 | 253 | 253 | 253 | 253 | 252 | 251 | 250 | 249 | 248 | 247 | 246 | 245 | 243 | 240 | 232 |
| 255 | 255 | 255 | 255 | 255 | 255 | 255 | 255 | 255 | 255 | 255 | 255 | 255 | 255 | 255 | 255 | 255 | 255 |

LIQUID CRYSTAL DISPLAY AND A DRIVING METHOD THEREOF

BACKGROUND OF THE INVENTION (a) Field of the Invention

The present invention relates to a Liquid Crystal Display (LCD) and a driving method thereof. More specifically, the present invention relates to an LCD and a driving method for providing compensated data voltage in order to improve a response time of the liquid crystal.

(b) Description of the Related Art

As personal computers (PCs) and televisions have recently become lighter in weight and slimmer in thickness, lighter and slimmer display devices have also been in great demand. Accordingly, flat panel type displays such as LCDs rather than cathode ray tubes (CRTS) are being developed.

In an LCD, a liquid crystal layer having anisotropic permittivity is injected between two substrates of a panel, and light transmittivity of the panel is controlled by applying and controlling an electric field to obtain desired images. An LCD is one of the most commonly used portable flat panel display devices. In particular, the thin film transistor liquid crystal display (TFT-LCD) employing the TFT as a switching element is most widely used.

As more TFT-LCDs have been used as display devices of computers and televisions, it has become increasingly important to enable display of moving pictures on the TFT-LCD. However, conventional TFT-LCDs have a relatively slow response speed, so it is difficult to enable moving pictures thereon. To solve the problem of slow response speed, a different type of TFT-LCD that uses an optically compensated band (OCB) mode or ferro-electric liquid crystal (FLC) materials has been developed.

However, the structure of the conventional TFT-LCD panel must be modified to use the OCB mode or the FLC materials. The Korean patent application No. 2000-5442 discloses a "Liquid crystal display and method thereof" to enhance the response speed of the LCD by modifying the liquid crystal driving method without modifying the structure of the TFT-LCD.

No. 2002-5442 generates a compensation data voltage by considering data voltages of present and previous frames, and provides the compensation data voltage to a data line of the LCD panel so that the pixel voltage becomes the target level immediately, and thereby the response quality is enhanced. The compensation data voltage is determined according to a dynamic capacitance and a response speed of the liquid crystal.

However, the dynamic capacitance and the response speed vary according to temperature. For example, when the temperature increases, the capacitance of liquid crystal decreases and the response speed of liquid crystal increases. Conversely, when the temperature decreases, the capacitance of the liquid crystal increases and the response speed decreases.

No. 2002-5442 compensates data voltage based on a predetermined compensation value with respect to a specific temperature, but parameters for setting the compensation value according to temperature vary as described above. Accordingly, over compensation occurs when a present temperature is higher than the specific temperature, and under compensation occurs when the present temperature is lower than the specific temperature, so correct data voltage compensation cannot be performed.

In an environment for displaying a moving picture rather than a PC graphics environment displaying a character or a still image, over-compensation of the data voltage is difficult to see, and the more the over-compensation occurs, the better the quality of the moving picture becomes.

FIG. 1 shows an example of compensating the moving picture in the prior art.

When the under compensation is performed by compensating the moving picture of a rectangular shape according to the prior art regardless of temperature, as shown in (a) of FIG. 1, a response time becomes slower than one frame time, so an afterimage occurs. When the over compensation is performed, as shown in (b) of FIG. 1, an artifact in which an edge of an object is exaggeratedly displayed occurs.

However, some viewers prefer a smooth picture that occurs when response speed of the LCD is low because of the under-compensation, and some viewers prefer an over-compensated picture in which an edge of an object is distinctly seen.

The prior art is deficient in that adaptive compensation is not performed because the data voltage is modified based on a fixed compensation voltage regardless of various parameters such as temperature, taste of a user, and environment.

SUMMARY OF THE INVENTION

The invention adaptively enhances the response speed of liquid crystal according to various parameters.

The invention further determines a compensation data voltage according to various parameters such as temperature, taste of a user, and environment to achieve the most suitable data voltage compensation when compensating the data voltage in consideration of the data voltage of the present frame and the data voltage of the previous frame together.

In one aspect of the present invention, an LCD comprises: an LCD panel comprising a plurality of gate lines for transmitting scanning signals, a plurality of data lines that are insulated from and that cross the gate lines for transmitting image signals, and a plurality of pixels that are formed in an area surrounded by the gate lines and the data lines and that are arranged as a matrix pattern and that have switching elements connected to the gate lines and data lines; a data gray signal modifier for receiving gray signals from a data gray signal source, and for outputting modification gray signals by considering gray signals of present and previous frames according to modification parameters; a gate driver for sequentially supplying the scanning signals; and a data driver for changing the modification gray signals into corresponding data voltages and outputting the image signals, wherein the modification parameter is at least one among a temperature, an image quality selected by a user, and an environment of the LCD.

The data gray signal modifier comprises: a frame storage device for receiving the gray signals from the data gray signal source, storing the gray signals for a period of one frame, and outputting the same; a controller for controlling writing and reading the gray signals of the frame storage device; and a data gray signal converter for considering the gray signals of a present frame transmitted by the data gray signal source and the gray signals of a previous frame transmitted by the frame storage device, and outputting the modification gray signals.

The data gray signal converter comprises: a storage device for storing a modification value to modify the data gray signal according to a plurality of modification parameters; a LUT (look-up table) selector for setting an ID of a LUT for selecting a LUT from the storage device and a coefficient value for converting modification values of the selected LUT based on the modification parameter; a LUT converter for reading the LUT corresponding to the ID from the storage device, converting the modification values of the read LUT according to the coefficient value, and outputting the converted LUT. a modification parameter input unit for reading modification values corresponding to gray signals of present and previous frames from the selected LUT or the converted LUT, and generating the modification gray signals based the modification values.

Wherein each compensation value of a LUT is $G_{ij}$, the present frame gray signal $G_n$ matching with $G_{ij}$ is expressed as $G_n=(i-1)\times 2^{8-y}$, and the previous frame gray signal $G_{n-1}$ matching with $G_{ij}$ is expressed as $G_{n-1}=(j-1)\times 2^{8-y}$.

Also, wherein the LUT converter modifies the compensation value $G_{ij}$ of the selected LUT so as to produce a compensation value $G_{ij}$ corresponding to the present temperature that satisfies the following equation when the present temperature does not correspond to the predetermined temperature:

$$G_{ij}'=G_{ij}+\alpha(G_{ij}-G_{ii})+\beta(G_{ij}-G_{ii})^2+\gamma(G_{ij}-G_{ii})^4+\ldots$$

where $G_{ii}=(i-1)\times 2^{8-y}$, and α, β, and γ are parameters for compensating the difference between the present temperature and the predetermined temperature.

The data gray signal converter comprises: a look-up table (LUT) for outputting variables (f, a, and b) compensating a moving image by considering the x-bit gray signal of a present frame transmitted by the data gray signal source and the y-bit gray signals of a previous frame transmitted by the frame storage device; and a calculator for generating and outputting the modification gray signals using the data gray signal of a previous frame, the z-bit LSB of the x-bit gray signal of a present frame, and variables f, a, and b.

Wherein the LUT converter modifies the variables a and b that satisfy the following equation according to the selected LUT when the present temperature does not correspond to the predetermined temperature:

$$\begin{aligned}
&= \{G_{i+1,i+1}+\alpha(G_{i+1,j}-G_{i+1,i+1})+\beta(G_{i+1,j}-G_{i+1,i+1})^2+\ldots\}-\\
&\quad \{G_{ii}+\alpha(G_{ij}-G_{ii})+\beta(G_{ij}-G_{ii})^2+\ldots\}\\
&= \{G_{ii}+\alpha(G_{i,j+1}-G_{ii})+\beta(G_{i,j+1}-G_{ii})^2+\ldots\}-\\
&\quad \{G_{ii}+\alpha(G_{ij}-G_{ii})+\beta(G_{ij}-G_{ii})^2+\ldots\}\\
a_{ij} &= G_{i+1,j}-G_{ij}\\
a_{ij}' &= G_{i+1,j}'-G_{ij}'\\
&= [G_{i+1,i+1}+\alpha(G_{i+1,j}-G_{i+1,i+1})+\beta(G_{i+1,j}-G_{i+1,i+1})^2+\ldots]\\
&= -[G_{ii}+\alpha[G_{ij}-G_{ii})+\beta(G_{ij}-G_{ii})^2+\ldots]\\
&= 2^{8-y}+\alpha(a_{ij}-2^{8-y})+\\
&\quad \beta(a_{ij}-2^{8-y})\times\{a_{ij}-2^{8-y}+2(G_{ij}-G_{ii})\}^2+\ldots\\
b_{ij} &= G_{ij+1}-G_{ij}, \text{ and}\\
b_{ij}' &= G_{ij+1}'-G_{ij}'\\
&= [G_{ii}+\alpha(G_{i,j+1}-G_{ii})+\beta(G_{i,j+1}-G_{ii})^2+\ldots]\\
&= -[G_{ii}+\alpha(G_{ij}-G_{ii})+\beta(G_{ij}-G_{ii})^2+\ldots]\\
&= \alpha\beta_{ij}+\beta b_{ij}\{b_{ij}+2(G_{ij}-G_{ii})\}^2+\ldots
\end{aligned}$$

wherein the modified gray data $G_n'$ are obtained using the equation $$G_n' = f([G_n]_z, [G_{n-1}]_z) + a([G_n]_z, [G_{n-1}]_z)\cdot\frac{{}_y[G_n]}{2^z} - b([G_n]_z, [G_{n-1}]_z)\cdot\frac{{}_y[G_n]}{2^z}$$

where z is the bit number of the LSBs, $[G_n])_z$ represents the MSB of $G_n$, $[G_n]_z$ represents the MSB OF $G_{n-1}$ and ${}_y[G_n]$ represents the LSB of $G_n$.

The LCD further comprises: a combiner for receiving the gray signals from the data gray signal source, combining the gray signals to be synchronized with the clock signal frequency with which the controller is synchronized, and outputting the combined gray signals to the frame storage device and the data gray signal converter; and a divider for dividing the gray signals output by the data gray signal converter so as to be synchronized with the frequency with which the gray signals transmitted by the data gray signal source are synchronized.

In another aspect of the present invention, a liquid crystal display (LCD) comprises a plurality of gate lines, a plurality of data lines being insulated from and crossing the gate lines, and a plurality of pixels formed in an area surrounded by the gate lines and data lines and arranged as a matrix pattern and having switching elements connected to the gate lines and data lines, an LCD driving method, comprising the steps of: (a) sequentially supplying scanning signals to the gate lines; (b) receiving image signals from an image signal source, and generating modification image signals by considering image signals of present and previous frames; and (c) supplying data voltages corresponding to the generated modification image signals to the data lines, wherein the modification parameter is at least one among a temperature, an image quality selected by a user, and an environment of the LCD.

The step for generating modification image signals, comprises the steps of: generating modification image signals based on a conversion table which has modification values matching with the previous frame image signal and the present image signal; and generating a new conversion table by converting the modification values generated in advance according to the modification parameter when the conversion table corresponding to the modification parameter is not existed, and generating the modification image signals based on the new conversion table.

It is desirable that the converting of the conversion table is performed during the data blank period.

BRIEF DESCRIPTION OF THE DRAWINGS

The accompanying drawings, which are incorporated in and constitute a part of the specification, illustrate an embodiment of the invention, and, together with the description, serve to explain the principles of the invention:

FIG. 6 shows a conversion table according to the preferred embodiment of the present invention;

DETAILED DESCRIPTION OF THE PREFERRED EMBODIMENTS

In the following detailed description, an embodiment of the invention has been shown and described, simply by way of illustrating the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

The LCD comprises a plurality of gate lines which transmit scanning signals, a plurality of data lines which cross the gate lines and transmit image data, and a plurality of pixels which are formed by regions defined by the gate lines and data lines, and which are interconnected through the gate lines, data lines, and switching elements.

Figure 1:
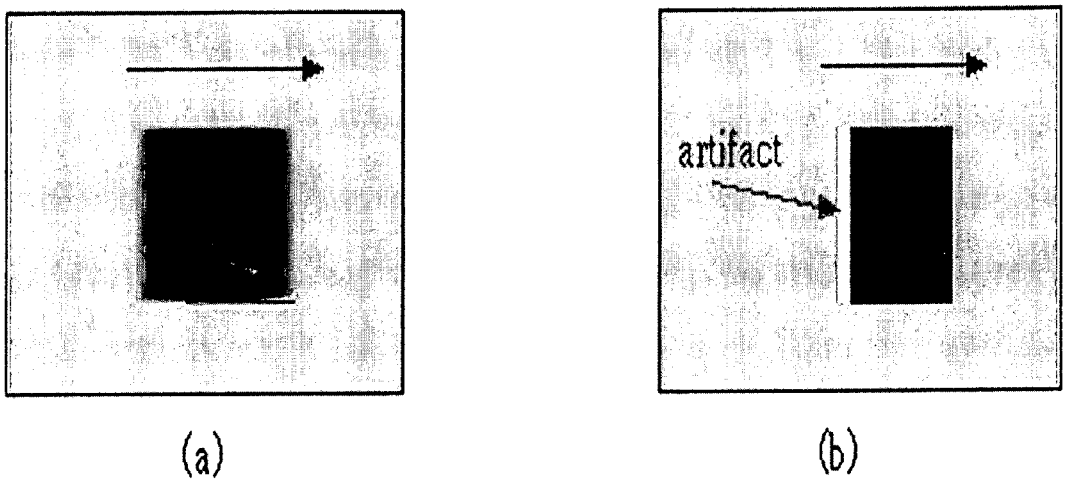
FIG.1 (Prior Art)
FIG. 1 shows an example of modifying a moving picture in a conventional liquid crystal display;.
Figure 2:
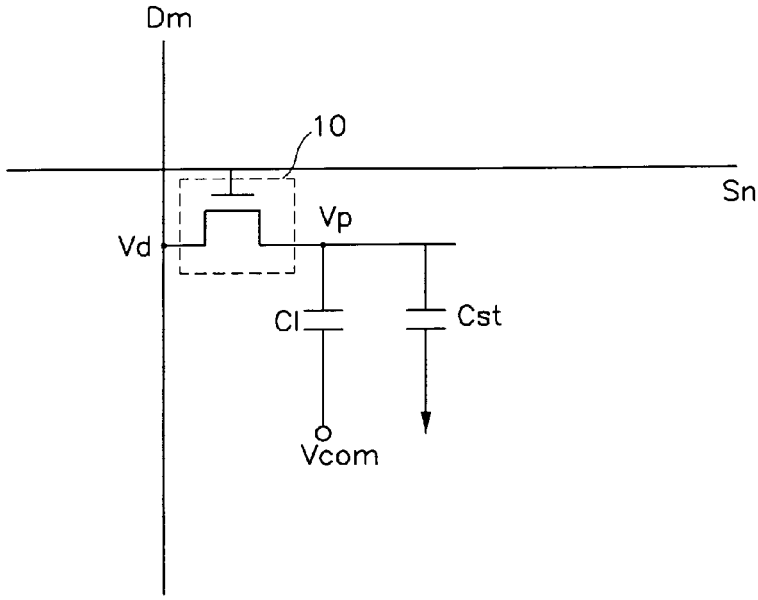
FIG. 2 shows an equivalence circuit of an LCD pixel.

Each pixel of the LCD can be modeled as a capacitor having the liquid crystal as a dielectric material, that is, a liquid crystal capacitor. FIG. 2 shows an equivalence circuit of the pixel of the LCD.

As shown in FIG. 2, an LCD pixel comprises a TFT 10 having a source electrode connected to a data line $D_m$ and a gate electrode connected to a gate line $S_n$, a liquid crystal capacitor $C_1$ connected between a drain electrode of the TFT 10 and a common voltage $V_{com}$, and a storage capacitor $C_{st}$ connected to the drain electrode of the TFT 10.

When a gate ON signal is supplied to the gate line $S_n$ to turn on the TFT 10, the data voltage $V_d$ supplied to the data line $D_m$ is supplied to each pixel electrode (not illustrated) via the TFT 10. Then, an electric field corresponding to a difference between the pixel voltage $V_p$ supplied to the pixel electrode and the common voltage $V_{com}$ is supplied to the liquid crystal (shown as the liquid crystal capacitor in FIG. 2) so that light permeates the TFT with a transmission corresponding to a strength of the electric field. At this time, the pixel voltage $V_p$ is maintained during one frame period. The storage capacitor $C_{st}$ is used in an auxiliary manner so as to maintain the pixel voltage $V_p$ supplied to the pixel electrode.

The liquid crystal has anisotropic permittivity, the permittivity depending on the direction the liquid crystal is aligned. That is, when a direction of the liquid crystal changes as the voltage is supplied to the liquid crystal, the permittivity also changes. Accordingly, the capacitance of the liquid crystal capacitor (which will be referred to as the liquid crystal capacitance) also changes. After the liquid crystal capacitor is charged while the TFT is turned ON, the TFT is then turned OFF. If the liquid crystal capacitance changes, the pixel voltage $V_p$ at the liquid crystal also changes, since Q=CV.

For example, in a normally white mode twisted nematic (TN) LCD, when zero voltage is supplied to the pixel, the liquid crystal capacitance C(0V) becomes $\epsilon_{\perp}A/d$, where $\epsilon_{\perp}$ represents the permittivity when the liquid crystal molecules are arranged in parallel with the LCD substrate, that is, when the liquid crystal molecules are arranged in the direction perpendicular to the direction of the light. 'A' represents the area of the LCD substrate, and 'd' represents the distance between the substrates. If the voltage for implementing a full black is set to be 5V, when the 5V voltage is supplied to the liquid crystal, the liquid crystal is arranged in the direction perpendicular to the substrate and therefore the liquid crystal capacitance C(5V) becomes $\epsilon_{//}A/d$. Since $\epsilon_{//}-\epsilon_{\perp}>0$ in the case of the liquid crystal used in the TN mode, the more the pixel voltage is supplied to the liquid crystal, the greater the liquid crystal capacitance becomes.

The amount of charge necessary for making the n-th frame full black is C(5V)×5V. However, if it is assumed that the (n−1)th frame is full white ($V_{n-1}$=0V), then, the liquid crystal capacitance becomes C(0V) since the liquid crystal has not yet responded during the TFT's turn ON period. Hence, even when the n-th frame supplies 5V data voltage $V_d$ to the pixel, the actual amount of the charge provided to the pixel becomes C(0V)×5V, and since C(0V)<C(5V), the pixel voltage below 5V (e.g., 3.5V) is actually supplied to the liquid crystal and the full black is not implemented. Further, when the (n+1)th frame supplies 5V data voltage $V_d$ so as to implement the full black, the amount of the charge actually provided to the liquid crystal becomes C(3.5V)×5V. Accordingly, the voltage $V_p$ actually supplied to the liquid crystal ranges between 3.5V and 5V. After repeating the above-noted process for a few frames, the pixel voltage $V_p$ reaches a desired voltage.

The above-noted description will now be described with respect to gray levels. When a signal (a pixel voltage) supplied to a pixel changes from a lower gray to a higher gray (or from a higher gray to a lower gray), the gray level of the present frame reaches the desired gray level after a few frames. This is because the gray level of the present frame is affected by the gray level of the previous frame. In a similar manner, the permittivity of the pixel of the present frame reaches a desired value after a few frames since the permittivity of the pixel of the present frame is affected by that of the pixels of the previous frame.

If the (n−1)th frame is full black, that is, the pixel voltage $V_p$ is 5V, and the n-th frame supplies 5V data voltage so as to implement the full black, the amount of the charge corresponding to C(5V)×5V is charged to the pixel since the liquid crystal capacitance is C(5V), and accordingly, the pixel voltage $V_p$ of the liquid crystal becomes 5V. Therefore, the pixel voltage $V_p$ actually supplied to the liquid crystal is determined by the data voltage supplied to the present frame as well as the pixel voltage $V_p$ of the previous frame.

In one embodiment of the present invention, a picture signal $G_n$ of the present frame is compared with a picture signal $G_{n-1}$ of a previous frame so as to generate a modification signal $G_n'$, and the modified picture signal $G_n'$ is supplied to each pixel. Here, the picture signal $G_n$ represents the data voltage in the case of an analog driving method, but the picture signal $G_m$ represents the gray signal in the case of a digital driving method. Accordingly, the actual modification of the voltage supplied to the pixel is performed by the modification of the gray signal in the digital driving method.

First, if the picture signal (the gray signal or data voltage) of the present frame is identical with the picture signal of the previous frame, the modification is not performed.

Second, if the picture signal of the present frame is higher than that of the previous frame, a modified picture signal that is higher than the present picture signal is output, and if the picture signal of the present frame is lower than that of the previous frame, a modified picture signal that is lower than the present picture signal is output. At this time, the modification degree is proportional to the difference between the present picture signal and the picture signal of the previous frame. Also, the modification degree varies according to modification parameters such as the present temperature, the taste of the viewer, and the environment.

A method for modifying the data voltage of the picture signal according to a preferred embodiment will now be described.

Figure 3:
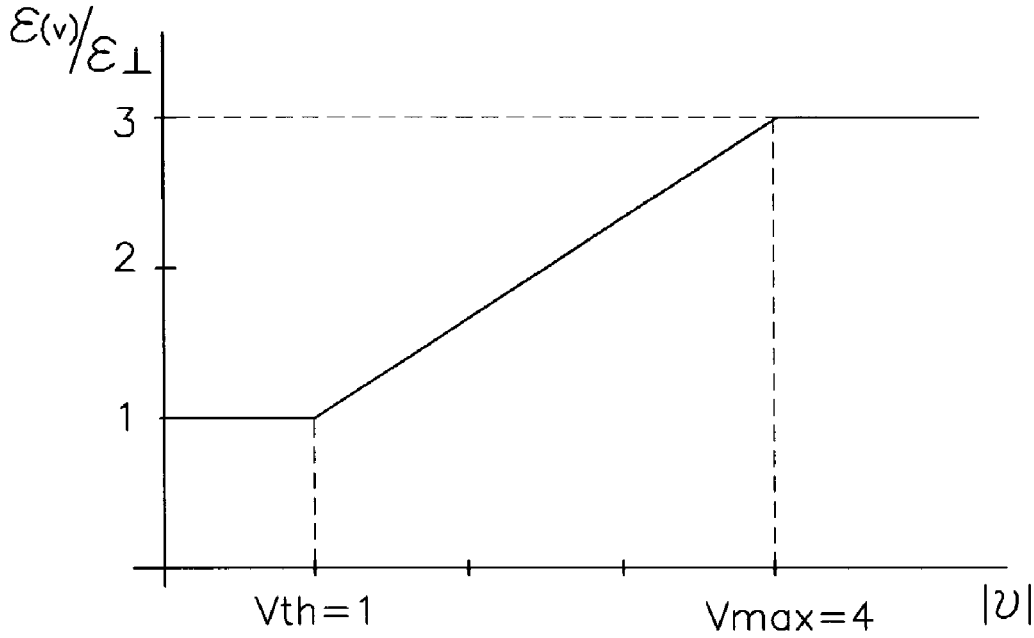
FIG. 3 shows a modeled relation between voltage and permittivity of the LCD.

FIG. 3 shows a model exhibiting the relationship between voltage and permittivity of the LCD.

As shown, the horizontal axis represents the pixel voltage. The vertical axis represents a ratio between the permittivity $\epsilon(v)$ at a certain level of pixel voltage v and the permittivity $\epsilon_\perp$ when the liquid crystal is arranged in parallel with the substrate: that is, when the liquid crystal lines are perpendicular to the permeating direction of the light.

The maximum value of $\epsilon(v)/\epsilon_\perp$, that is, $\epsilon_{//}/\epsilon_\perp$ is assumed to be 3, $V_{th}$ is assumed to be 1V, and $V_{max}$ is assumed to be 4V. Here, $V_{th}$ and $V_{max}$ respectively represent the pixel voltages of the full white and full black (or vice versa).

When the capacitance of the storage capacitor (which will be referred to as the storage capacitance) is set to be identical to an average value $<C_l>$ of the liquid crystal capacitance, and the area of the LCD substrate and distance between the substrates are respectively set to be 'A' and 'd', the storage capacitance $C_{st}$ can be expressed as Equation 1.

$$C_{st}=<C_l>=(1/3)\cdot(\epsilon_{//}+2\epsilon_\perp)\cdot(A/d)=(5/3)\cdot(\epsilon_\perp\cdot A/d)=(5/3)\cdot C0 \quad \text{Equation 1}$$

where $C0=\epsilon_\perp\cdot A/d$.

Figure 4:
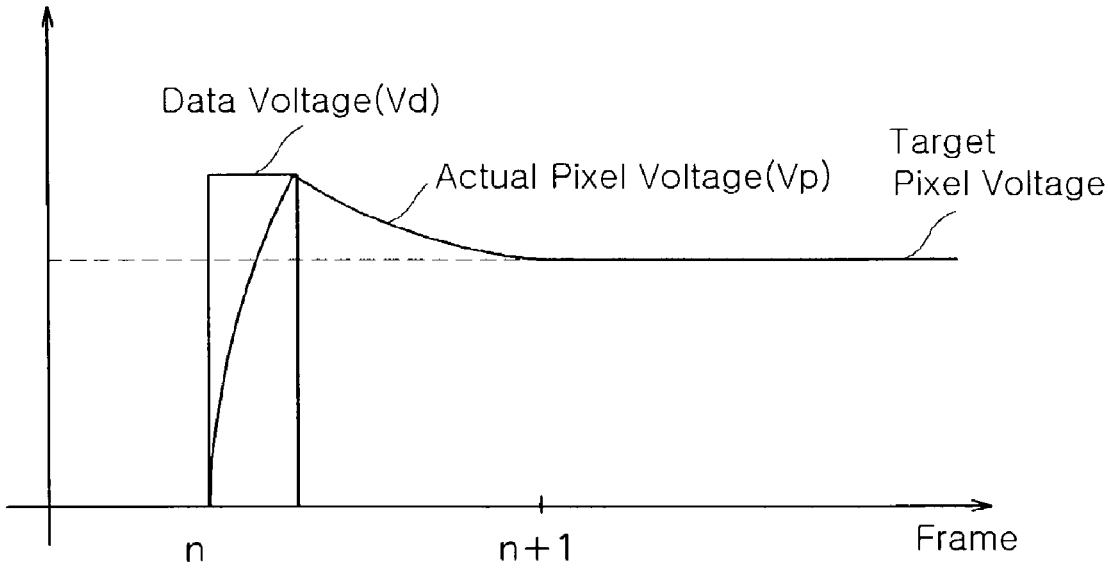
FIG. 4 shows a method for supplying data voltage according to a preferred embodiment of the present invention.

Referring to FIG. 4, $\epsilon(v)/\epsilon_\perp$ can be expressed as Equation 2.

$$\epsilon(v)/\epsilon_\perp=(1/3)\cdot(2V+1) \quad \text{Equation 2}$$

Since total capacitance C(V) of the LCD is the sum of the liquid crystal and the storage capacitances, the capacitance C(V) can be expressed in Equation 3 from Equations 1 and 2.

$$\begin{aligned} C(V) &= C_l + C_{st} = \varepsilon(v)\cdot(A/d) + (5/3)\cdot C0 \quad \text{Equation 3} \\ &= (1/3)\cdot(2V+1)\cdot C0 + (5/3)\cdot C0 \\ &= (2/3)\cdot(V+3)\cdot C0 \end{aligned}$$

Since the charge Q supplied to the pixel is preserved, the following Equation 4 is established.

$$Q=C(V_{n-1})\cdot V_n=C(V_f)\cdot V_f \quad \text{Equation 4}$$

Equation 5 can be derived from Equations 3 and 4.

$$C(V_{n-1})\cdot V_n=C(V_f)\cdot V_f=(2/3)\cdot(V_{n-1}+3)\cdot V_n=(2/3)\cdot(V_f+3)\cdot V_f \quad \text{Equation 5}$$

where $V_n$ represents the data voltage (or, an absolute value of the data voltage of an inverting driving method) to be supplied to the present frame, $C(V_{n-1})$ represents the capacitance corresponding to the pixel voltage of the previous frame (that is, (n−1)th frame), and $C(V_f)$ represents the capacitance corresponding to the actual voltage $V_f$ of the pixel of the present frame (that is, nth frame).

Referring to Equation 5, the actual pixel voltage $V_f$ can be expressed as Equation 6.

$$V_f=(-3+mt;epmrl;\sqrt{9+4italVmedinfbeginitalnendital-reset(italVmedinfbeginitaln-endital1reset+beginbold3endbold)rlxmx})/2 \quad \text{Equation 5}$$

As clearly expressed in Equation 6, the actual pixel voltage $V_f$ is determined by the data voltage $V_n$ supplied to the present frame and the pixel voltage $V_{n-1}$ supplied to the previous frame.

If the data voltage supplied in order for the pixel voltage to reach the target voltage $V_n$ at the n-th frame is set to be $V_n'$, the data voltage $V_n'$ can be expressed as Equation 7 from Equation 5.

$$(V_{n-1}+3)\cdot V_n'=(V_n+3)\cdot V_n \quad \text{Equation 7}$$

Hence, the data voltage $V_n'$ can be expressed as Equation 8.

$$V_n'=\frac{V_{n+3}}{V_{n-1}+3}\cdot V_n=V_n+\frac{V_n-V_{n-1}}{V_{n-1}+3}\cdot V_n \quad \text{Equation 8}$$

As noted-above, when supplying the data voltage $V_n'$ obtained by the Equation 8 by the consideration of the target pixel voltage $V_n$ of the present frame and the pixel voltage $V_{n-1}$ of the previous frame, the pixel voltage can directly reach the target pixel voltage $V_n$.

Equation 8 is derived from FIG. 4 and a few assumptions, and the data voltage $V_n'$ applied to the general LCD can be expressed as Equation 9.

$$|V_n'|=|V_n|+f(|V_n|-|V_{n-1}|) \quad \text{Equation 9}$$

where the function $f$ is determined by the characteristics of the LCD. The function $f$ has the following characteristics:

$f=0$ when $|V_n|=|V_{n-1}|$, $f>0$ when $|V_n|>|V_{n-1}|$, and $f<0$ when $|V_n|<|V_{n-1}|$.

Figure 5:
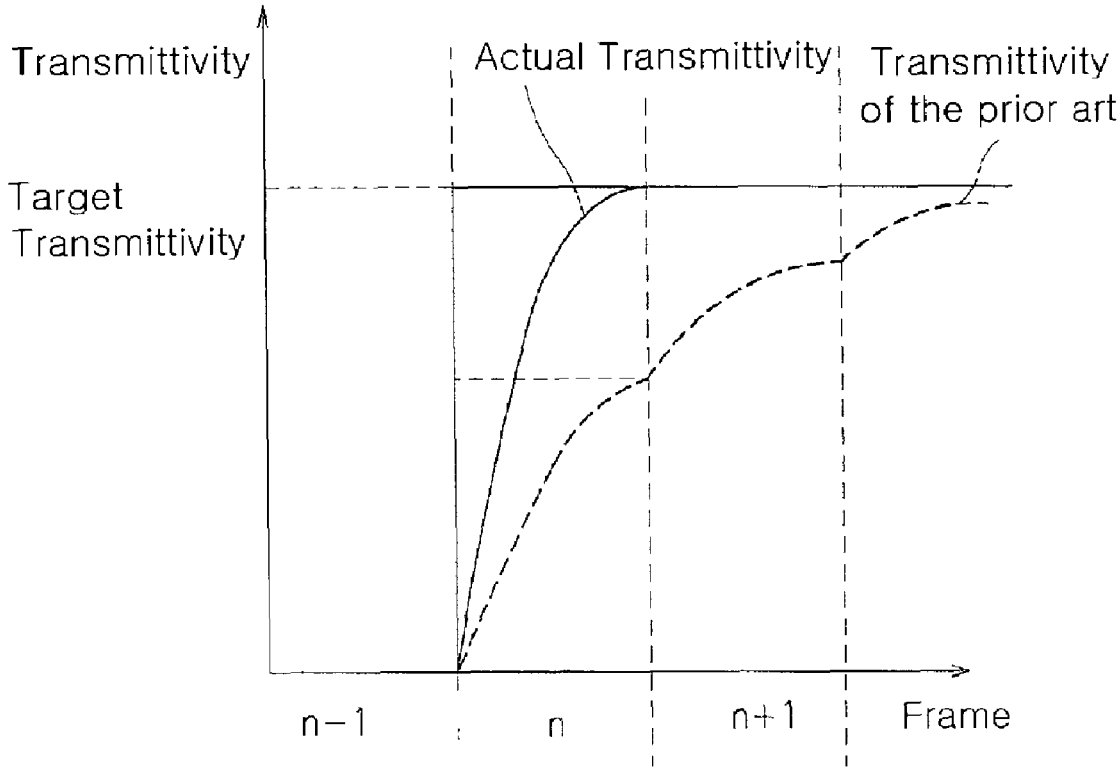
FIG. 5 shows a light transmission rate of an LCD when supplying data voltage according to the preferred embodiment of the present invention.

FIG. 4 shows the method for supplying the data voltage according to the preferred embodiment of the present invention. FIG. 5 shows a permittivity of the LCD in the case of supplying the data voltage.

As shown in FIG. 4, the data voltage $V_n'$ modified by the formula considering the target pixel voltage of the present frame and the pixel voltage (data voltage) of the previous frame is supplied so that the pixel voltage $V_p$ reaches the target voltage. In other words, when the target voltage of the present frame is different from the pixel voltage of the previous frame, the voltage higher (or lower) than the target voltage of the present frame is supplied as the modified data voltage so as to reach the target voltage level at the first frame, and after this, the target voltage is supplied as the data voltage at the following frames. This improves the response speed of the liquid crystal.

At this time, the modified data voltage (charges) is determined by considering the liquid crystal capacitance determined by the pixel voltage of the previous frame. That is, the charge Q is supplied by considering the pixel voltage level of the previous frame so as to directly reach the target voltage level at the first frame.

As shown in FIG. 5, since the modified data voltage is supplied according to the preferred embodiment, the permittivity directly reaches the target permittivity at the present frame.

On the other hand, a modified voltage $V_n'$ that is a little higher than the target voltage can be supplied as the pixel voltage. FIG. 6 shows a permittivity of the LCD in this case. As shown in FIG. 6, the permittivity becomes lower than the target permittivity before a half of the response time of the liquid crystal, but after this, the permittivity becomes over compensated compared to the target value so that the average permittivity becomes equal to the target permittivity.

Particularly, the preferred embodiment of the present invention generates a modified voltage $V_n'$ considering the target pixel voltage of the present frame and the pixel voltage (data voltage) of the previous frame, and the modified voltage $V_n'$ adaptively changes according to the compensation parameters such as temperature.

For the modification of the data voltage, digital circuits manufactured to satisfy the equation 9 at each temperature can be used. Also, after look-up tables (which will be referred as LUT) having compensation values by temperature are made and stored in a ROM, the data voltage (picture signal) can be modified based on the compensation value read by accessing the LUT. Actually, a modified data voltage $V_n'$ depends on the difference between the data voltage $V_{n-1}$ of the previous frame and the data voltage $V_n$ of the present frame as well as $|V_n|$ and $|V_{n-1}|$. If the LUT is made, it is advantageous in that a circuit is implanted more simply than through calculation processing.

Therefore, the preferred embodiment of the present invention makes a plurality of LUTs having compensation values by temperature to generate a data voltage to satisfy the equation 9, selects a LUT among the plurality of LUTs according to the present temperature of the LCD, and then performs a modification of data voltage, that is, a modification of a gray signal, based on the selected LUT. However, it is difficult to make LUTs for all temperatures and also to store all LUTs in a storage medium such as a ROM.

In the preferred embodiment of the present invention, a plurality of LUTs of the predetermined temperatures are made, and then when a measured temperature does not correspond to the predetermined temperatures, a new compensation value according to the measured temperature is generated by converting the compensation value of the LUT according to the following method, so as to enhance the efficiency of the data voltage modification.

The method for converting the LUT will now be described.

When the present temperature does not correspond to one of the predetermined temperatures that the LUT has previously made, for example, when each of the predetermined temperatures that the LUT has previously made are 25° C., 40° C., and 0° C., respectively, and the present temperature is 20° C., the LUT conversion is performed as follows.

It will be assumed that each compensation value within a LUT is represented by $G_{ij}$. For example, when a gray signal is 8-bits, if the MSB (most significant bit) y-bit among 8-bit gray signals is stored in the LUT, $G_{ij}$ can be expressed as Equation 10.

$$G_{ij}=G_n' \qquad \text{Equation 9}$$

where $G_n=(i-1)\times 2^{8-y}$, $G_{n-1}=(j-1)\times 2^{8-y}$

For example, if the LUT is made of compensation values represented as MSB 4-bits among 8-bit gray signals, $G_{23}=G_n'$ ($G_n=1\times 16=16$, $G_{n-1}=2\times 16=32$), and accordingly, $G_{23}$ represents a compensation value when a gray of the present frame is 16 and a gray of the previous frame is 32.

Each compensation value of the LUT is matched with a gray of the present frame and a gray of the previous frame as above-noted, and the matched value depends on how many bits among the total bits of a gray signal are used.

FIG. 6 shows an example of a LUT according to the preferred embodiment of the present invention. The LUT shown in FIG. 6 corresponds to the case of storing a MSB 4-bit among 8-bits of a gray signal.

It will be assumed that $G_{ij}$ of the LUT is represented as equation 10. If the present temperature does not correspond to one of the predetermined temperatures, each $G_{ij}$ of the LUTs corresponding to the predetermined temperature of which the difference from the present temperature is the smallest among a plurality of the predetermined temperatures is converted as equation 11.

$$G_{ij}'=G_{ij}+\alpha(G_{ij}-G_{ii})+\beta(G_{ij}-G_{ii})^2+\gamma(G_{ij}-G_{ii})^4+\ldots \qquad \text{Equation 9}$$

where $G_{ii}=(i-1)\times 2^{8-y}$.

Such α, β, and γ of each term of equation 11 are factors for compensating the difference between the present temperature and the predetermined temperature. When the present temperature is lower than the predetermined temperature, a factor such as α is set to be larger than 1 so that a greater degree of compensation is performed. When the present temperature is higher than the predetermined temperature, the factor such as α is set to be smaller than 1 so that a lesser degree of compensation is performed.

For example, when only the first term in equation 11 is used (that is, β=γ= . . . =0), and if much compensation is required because the present temperature is lower than the predetermined temperature, the compensation is performed as α>1. If small compensation is reduced because the present temperature is higher than the predetermined temperature, the compensation is performed as α<1.

Compensation factors such as α, β, and γ can be changed according to a taste of a user who prefers an over compensated image or an under compensated image. Also, compensation factors can be changed based on whether the present displayed image is mostly a static-graphics image or a dynamic image.

If compensation values for the MSB y-bit are stored in the LUT as well as coefficients for compensation of the LSB (least significant bit), the coefficients may be changed with compensation values. That is, if all the bits of the gray signal are x-bits, MSB y-bits of x-bits are modified by using a LUT, and the remaining LSB z-bits (that is, x-y bits) of the x-bits are modified by a calculation.

Modified gray data are generated by calculating parameters (f, a, b) provided from the LUT according to the gray signal of the previous frame and the MSB y-bit of the x-bit gray signal of the present frame, as well as the LSB z-bit of the x-bits gray signal of the present frame, where f=($G_n$, $G_{n-1}$) and is a compensation value corresponding to the gray signal of the previous frame and the gray signal of the present frame, and a and b are integers and represent the difference between the compensation value of the present pixel and the compensation values of the neighboring cell.

The gray data modified by considering the LUT satisfies the following Equation $$G_n' = f([G_n]_z, [G_{n-1}]_z) + a([G_n]_z, [G_{n-1}]_z)\cdot\frac{y[G_n]}{2^z} - b([G_n]_z, [G_{n-1}]_z)\cdot\frac{y[G_n]}{2^z} \qquad \text{Equation 12}$$

where z is the bit number of the LSBs, $[G]_z$ represents the MSB of $G_n$, $[G_n]_z$ represents the MSB of $G_{n-1}$ and $_y[G_n]$ represents the LSB of $G_n$.

When $[G_n]_z$32 $[G_{n-1}]_z$, if a−b=16, then $G'_n=G_{n-1}$. Also, if a'−b=0, then $G'_n=G_{n-1}$.

As above-noted, if coefficients a and b are required for calculation, coefficients according to the present temperature are obtained based on the LUT of the predetermined temperature, as follows.

$$\begin{aligned} &= \{G_{i+1,i+1} + \alpha(G_{i+1,j} - G_{i+1,i+1}) + \\ &\quad \beta(G_{i+1,j} - G_{i+1,i+1})^2 + \ldots\} \\ &\quad -\{G_{ii} + \alpha(G_{ij} - G_{ii}) + \beta(G_{ij} - G_{ii})^2 + \ldots\} \end{aligned} \qquad \text{Equation 13}$$

$$a_{ij} = G_{i+1,j} - G_{ij},$$

$$a'_{ij} = G'_{i+1,j} - G'_{ij},$$

-continued $$= [G_{i+1,i+1} + \alpha(G_{i+1,j} - G_{i+1,i+1}) + \beta(G_{i+1,j} - G_{i+1,i+1})^2 + \dots ]$$

$$= -[G_{ii} + \alpha[G_{ij} - G_{ii}) + \beta(G_{ij} - G_{ii})^2 + \dots ]$$

$$= 2^{8-y} + \alpha(a_{ij} - 2^{8-y}) + \beta(a_{ij} - 2^{8-y}) \times \{a_{ij} - 2^{8-y} + 2(G_{ij} - G_{ii})\}^2 + \dots$$

$$= \{G_{ii} + \alpha(G_{i,j+1} - G_{ii}) + \beta(G_{i,j+1} - G_{ii})^2 + \dots \} - \{G_{ii} + \alpha(G_{ij} - G_{ii}) + \beta(G_{ij} - G_{ii})^2 + \dots \} \quad \text{Equation 14}$$

$$= \{G_{ii} + \alpha(G_{i,j+1} - G_{ii}) + \beta(G_{i,j+1} - G_{ii})^2 + \dots \} - \{G_{ii} + \alpha(G_{ij} - G_{ii}) + \beta(G_{ij} - G_{ii})^2 + \dots \}$$

$b_{ij} = G_{ij+1} - G_{ij}$, and $b'_{ij} = G'_{ij+1} - G'_{ij}$, $$= [G_{ii} + \alpha(G_{i,j+1} - G_{ii}) + \beta(G_{i,j+1} - G_{ii})^2 + \dots ] - [G_{ii} + \alpha(G_{ij} - G_{ii}) + \beta(G_{ij} - G_{ii})^2 + \dots ]$$

$$= \alpha\beta_{ij} + \beta b_{ij}\{b_{ij} + 2(G_{ij} - G_{ii})\}^2 + \dots$$

$$b_{ij} = G_{ij+1} - G_{ij} \quad \text{Equation 14}$$

$$b'_{ij} = G'_{ij+1} - G'_{ij}$$

$$= \{G_{ii} + \alpha(G_{i,j+1} - G_{ii}) + \beta(G_{i,j+1} - G_{ii})^2 + \cdots \} - \{G_{ii} + \alpha(G_{ij} - G_{ii}) + \beta(G_{ij} - G_{ii})^2 + \cdots \}$$

$$= \alpha\beta_{ij} + \beta b_{ij}\{b_{ij} + 2(G_{ij} - G_{ii})\}^2 + \cdots$$

That is, if the cell which is located in the i row and the j column of the LUT corresponding to the predetermined temperature is read, $G_{ij}'$, $a_{ij}'$, and $b_{ij}'$ can be calculated.

As described above, when the measured temperature does not correspond to a plurality of predetermined temperatures, the LUT conversion is performed by using the LUT corresponding to the predetermined temperature of which the difference from the present temperature is smallest, and then the modified LUT suitable to the present temperature is generated.

For example, when the first LUT to the nth LUT according to the plurality of predetermined temperatures are generated in advance and the first LUT is set as default, if the difference between the present measured temperature and the predetermined temperature of the first LUT is lower than the predetermined value, the modification of the gray signal is performed based on the first LUT as described above. However, if the difference between the present measured temperature and the predetermined temperature of the first LUT is larger than the predetermined value, the modification is performed by selecting a LUT corresponding to the predetermined temperature of which the difference from the present measured temperature is lower than the predetermined value. At this time, it is desirable that the LUT corresponding to the predetermined temperature that has the smallest difference from the present temperature is selected.

An LCD according to a preferred embodiment of the present invention will now be described.

Figure 7:
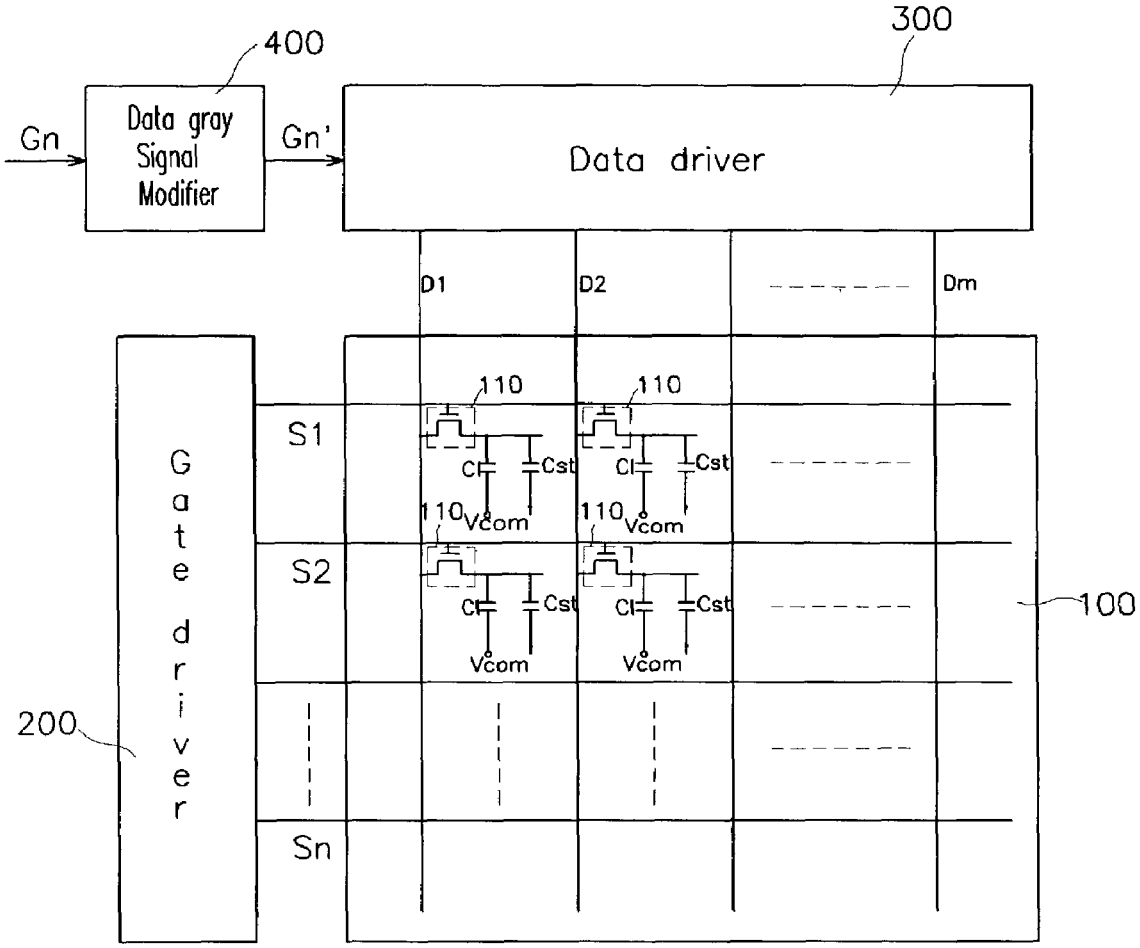
FIG. 7 shows an LCD according to the preferred embodiment of the present invention.

FIG. 7 shows an LCD according to the preferred embodiment of the present invention. The LCD according to the preferred embodiment uses a digital driving method.

As shown in FIG. 7, the LCD according to the preferred embodiment of the present invention comprises an LCD panel 100, a gate driver 200, a data driver 300, and a data gray signal modifier 400.

A plurality of gate lines S1, S2, . . . , Sn for transmitting gate ON signals, and a plurality of data lines D1, D2, . . . , Dn for transmitting the modified data voltages are formed on the LCD panel 100. An area surrounded by the gate lines and data lines forms a pixel, and the pixel comprises TFTs 110 having a gate electrode connected to the gate line and having a source electrode connected to the data line, a pixel capacitor $C_l$ connected to a drain electrode of the TFT 110, and a storage capacitor $C_{st}$.

The gate driver 200 sequentially supplies the gate ON voltage to the gate lines so as to turn on the TFT having a gate electrode connected to the gate line to which the gate ON voltage is supplied.

The data gray signal modifier 400 receives n-bit data gray signals $G_n$ from a data source (e.g., a graphic signal controller), and outputs the m-bit modified data gray signals $G_n'$ after considering the m-bit data gray signals of the present and previous frames. At this time, the data gray signal modifier 400 can be a stand-alone unit or it can be integrated into a graphic card or an LCD module.

The data driver 300 converts the modified gray signals $G_n'$ received from the data gray signal modifier 400 into corresponding gray voltages (data voltages) so as to supply the same to the data lines.

Figure 8:
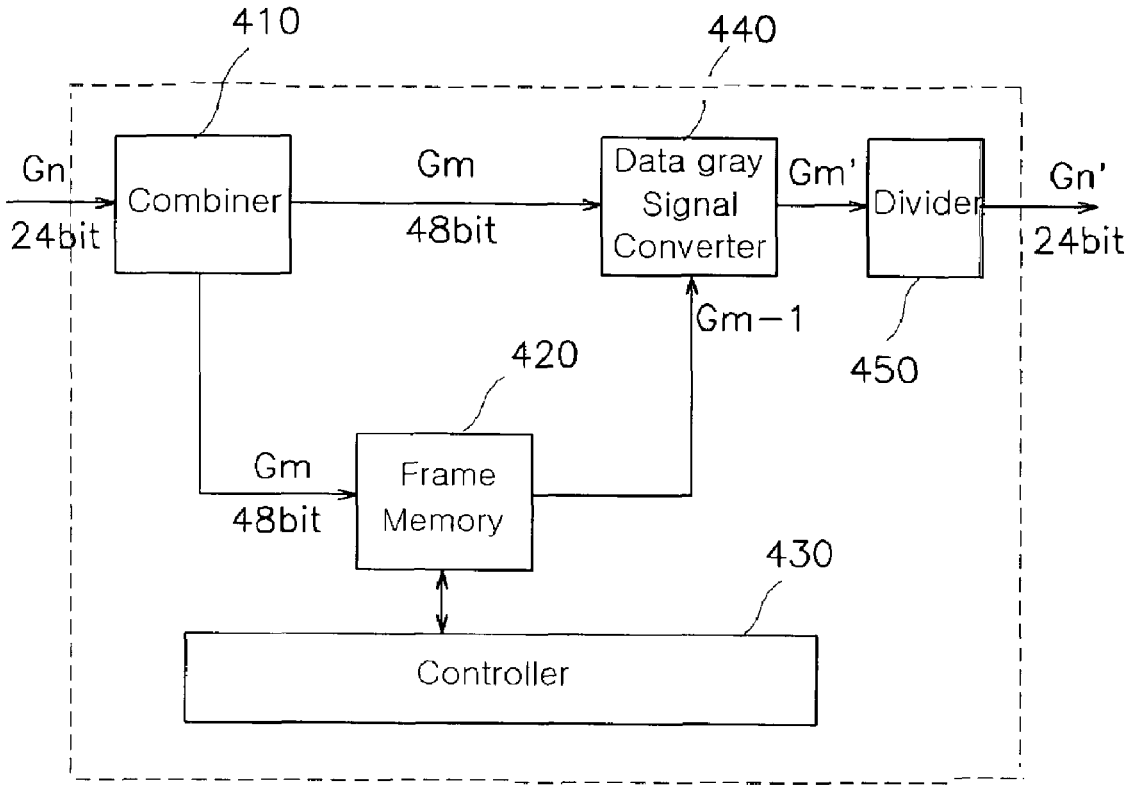
FIG. 8 shows a data gray signal modifier according to the preferred embodiment of the present invention.

FIG. 8 shows a detailed block diagram of the data gray signal modifier 400 of FIG. 7.

As shown, the data gray signal modifier 400 comprises a combiner 410, a frame memory 420, a controller 430, a data gray signal converter 440, and a divider 450.

The combiner 410 receives gray signals from the data source, and converts the frequency of the data stream into a speed that can be processed by the data gray signal modifier 400. For example, if 24-bit data synchronized with a 65 MHz frequency are transmitted from the data gray signal source and the processing speed of the components of the data gray signal modifier 400 is limited to within 50 MHz, the combiner 410 combines the 24-bit gray signals into 48-bit gray signals $G_m$ two by two and then transmits the same to the frame memory 420.

The combined gray signals $G_m$ output the previous gray signals $G_{m-1}$ stored in a predetermined address to the data gray signal converter 440 according to a control process by the controller 430 and concurrently store the gray signals $G_m$ transmitted by the combiner 410 in the above-noted address. The data gray signal converter 440 receives the present frame gray signals $G_m$ output from the combiner 410 and the previous frame gray signals $G_{m-1}$ output from the frame memory 420, and generates modified gray signals $G_m'$ by processing the gray signals of the present and previous frames.

The divider 450 divides 48-bit modified data gray signals $G_m'$ from the data gray signal converter 440 and outputs 24-bit modified gray signals $G_n'$.

In the preferred embodiment of the present invention, since the clock frequency synchronized to the data gray signal is different from that for accessing the frame memory 420, the combiner 410 and the divider 450 are needed, but in the case the clock frequency synchronized to the data gray signal is identical with that for accessing the frame memory 420, the combiner 410 and the divider 450 are not needed.

Figure 9:
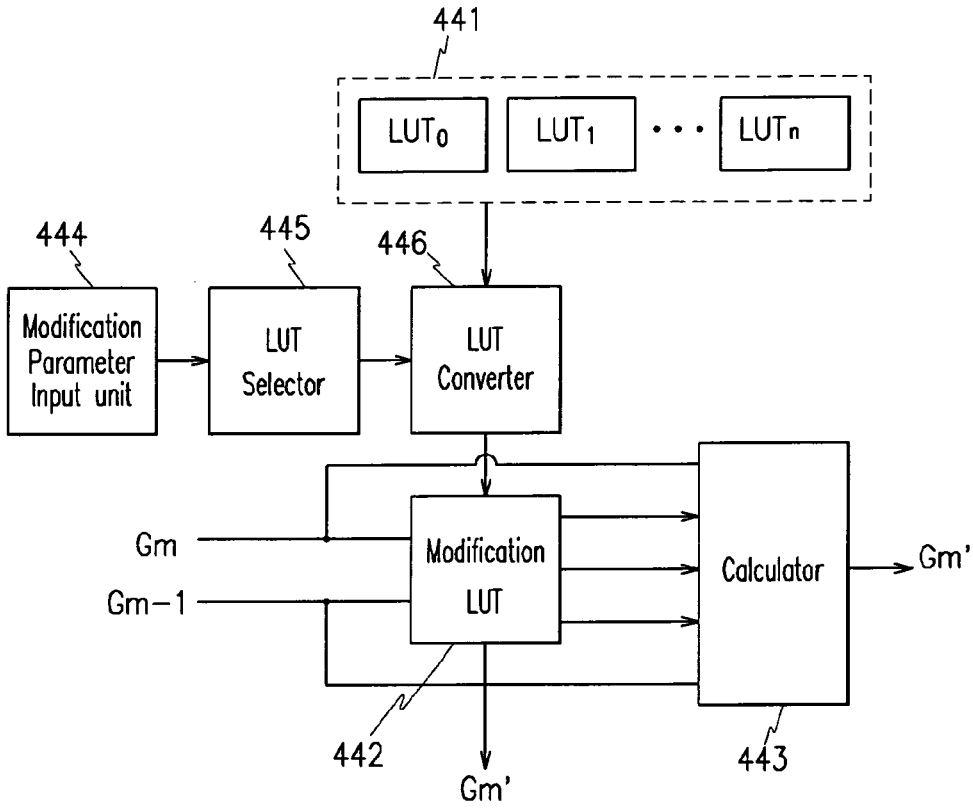
FIG. 9 shows a data gray signal converter according to a second embodiment of the present invention.

FIG. 9 shows a detailed block diagram of the data gray signal converter 440 of FIG. 8.

As shown in FIG. 9, the data gray signal converter 440 comprises a LUT storage unit 441, a calculator 443, a modification parameter input unit 444, a LUT selector 445, and a LUT converter 446.

The LUT storage unit 441 includes the plurality of the $LUT_0$ to LUTn that have values for modifying the gray signal by the plurality of predetermined temperatures.

The modification parameter input unit 444 receives parameters for determining how many modifications of the gray signal will be performed, selecting a LUT, and changing compensation values of the selected LUT, and provides the same to the LUT selector 445. That is, temperature data from a sensor for measuring the present temperature of the LCD, image quality selecting data according to the user's taste output from a keyboard or a button, and environment data (i.e. whether the LCD displays static graphics or moving graphics). These data are digital signals and can be inputted to the modification parameter input unit 444 in parallel or serially. Also, these data are inputted to the modification parameter input unit 444 as an analog signal, and can then be converted to a digital signal.

The LUT selector 445 selects a suitable LUT and determines a coefficient value for performing a LUT conversion according to the modification parameter such as the temperature data, the image quality selecting data, and the environment data from the modification parameter input unit 444. That is, the LUT selector 445 determines a LUT ID and values of compensation coefficients ($\alpha$, $\beta$, . . . ) by considering what LUT is selected and how many changes of the compensation value according to the modification parameters will be performed.

The LUT selector 445 can be embodied as the simple type of LUT as shown in the following Table 1 when a number of the compensation coefficients is small, and it can be embodied so as to calculate the compensation coefficients using an algorithm when the number of compensation coefficients is large.

TABLE 1

| | LUT ID | $\alpha$ | $\beta$ |
|---|---|---|---|
| 0 | 0 | 0.75 | −0.025 |
| 1 | 0 | 1 | 0 |
| 2 | 0 | 1.25 | 0.025 |
| 3 | 1 | 0.75 | −0.025 |
| 4 | 1 | 1 | 0 |
| 5 | 1 | 1.25 | 0.025 |
| 6 | 2 | 0.75 | −0.025 |
| 7 | 2 | 1 | 0 |

The LUT converter 446 reads a LUT corresponding to the ID from the LUT selector 445 and from the LUT storage unit 441.

When the compensation coefficients for obtaining modified values by modifying the value of the LUT are provided from the LUT selector 445, the LUT converter 446 obtains a compensation value of a LUT suitable for the present temperature by modifying each value of the LUT provided from the LUT storage unit 441 as in the above modification method based on the compensation coefficient. The LUT obtained by the LUT converter 446 is used as a modification LUT 442 for outputting a modified gray signal $G_n'$ considering gray signals of the previous frame and the present frame.

The modification LUT 442 provides a compensation value matched to the present frame gray signal $G_m$ from the combiner 410 and the previous frame gray signal $G_{m-1}$ to a calculator 443. The calculator 443 generates the modified gray signal $G_n$ by performing a calculation based on the compensation value, and transmits the same to the divider 450.

When a modification for the MSB y-bit as well as a modification for the LSB z-bit is made in a LUT, the calculator 443 generates a modified gray signal $G_m'$ by performing a calculation using the LSB 4-bit of the present frame gray signal $G_m$ from the combiner 410, the LSB 4-bit of the previous frame gray signal $G_{m-1}$ from the frame memory 420, and parameters f, a, and b for compensating a moving picture from the compensation LUT 442, and outputs the same to the divider 450.

The 48-bit modified gray signal $G_m'$ is divided by the divider 450 and is output to the data driver 300 as a 24-bit modified gray signal $G_m'$. It is desirable that such LUT conversion is performed during a data blank period.

In the above-described embodiments, the modification values which correspond to the gray signals of the present frame and the previous frame in a LUT by temperatures can be at least two. The modification values may be selected according to the taste of a user or the using environment with the selected modification value being modified as described above.

Also, the plurality of LUTs or the LUT selector may be varied according to the product, and the modification values and the coefficients may be implanted in various ways. For example, the plurality of LUTs or the LUT selector can be embodied as a storage service. In this case, the interface with the outside is not needed and a space occupied by LUTs or the LUT selector is small compared with the case of being implanted as an SRAM. It is advantageous in that the problem ratio becomes low, but a new data gray signal modifier may be designed when many liquid crystal parameters are changed.

The plurality of LUTs or the LUT selector can be embodied as a type of external ROM. In this case, the data gray signal modifier reads data from the external ROM whenever needed. Generally, it is desirable that the data gray signal modifier reads data from the external ROM in power-up. However, when the data gray signal modifier made of a chip has not enough space suitable for storing all of the LUTs, the data gray signal modifier reads the LUT that is designated as a default, and it can then read LUTs one by one if need be. At this time, various models of the liquid crystal devices can be adapted, but an interface with an external ROM is needed and the possibility of problems increases because of an increment of components.

Also, it is possible that the modification values of the plurality of LUTs or the LUT selector are received through a graphics signal. In this case, a protocol for transmitting the graphics signal is needed. Data for informing that an inputted signal is not a signal to be displayed, but rather that it is a LUT and a modification value according to the LUT, or data for informing that some parts among the inputted signal correspond to the compensation coefficient, or data for informing that some parts among the inputted signal correspond to the data for the LUT, and so on, are needed. It is desirable that the order for inputting these data is fixed between a transmitter and a receiver.

A method for inputting the LUT and the compensation coefficients through a graphics signal is embodied as follows.

For example, the data can be transmitted in a display blank period in a liquid crystal device including an LCD module. Also, it is possible that a user pushes a LUT-setting button after operating specific software in a computer environment so as to transmit these data. At this time, the software may be a bit-map indicator in which the information comprising the LUT or LUT selector is stored according a specific rule.

When compensation data of the LUT and compensation coefficients are provided as a type of bit-map, it is possible that the compensation may be changed according to various models, users may easily change the compensation data using software, and an interface with an external device is not needed, thereby reducing a problem ratio.

According to the above-noted embodiment of the present invention, the most suitable data voltage is provided according to the modification parameter such as the temperature. As a result, the pixel voltage can reach the target voltage level immediately and then the response speed of the liquid crystal can be improved without changing the panel construction of the TFT_LCD.

While the present disclosure has been described in connection with what is presently considered to be the most practical and preferred embodiment, it is to be understood that the invention is not limited to the disclosed embodiments, but on the contrary, is intended to cover various modifications and equivalent arrangements included within the spirit and scope of the appended claims.

What is claimed is:

1. A liquid crystal display (LCD) comprising:

an LCD panel comprising a plurality of gate lines for transmitting scanning signals, a plurality of data lines that cross the gate lines for transmitting image signals, and a plurality of pixels that are arranged in a matrix and have switching elements connected to the gate lines and the data lines;

a data gray signal modifier that receives gray signals from an external device, and modifies gray signals of a present frame based on gray signals of present and previous frames and at least a modification parameter including a temperature, an image quality selected by a user, and an environment of the LCD;

a gate driver sequentially applying the scanning signals to the gate lines; and a data driver that converts the modified gray signals into data voltages and applies the data voltages to the data lines, wherein the data gray signal modifier includes a look-up table (LUT) for a reference value of the at least a modification parameter, the LUT has modification values for modifying gray signals, and each modification value of the LUT is represented by $G_{ij}$, the present frame gray signal $G_n$ matching with $G_{ij}$ is expressed as $G_n=(i-1)\times 2^{8-y}$, and the previous frame gray signal $G_{n-1}$ matching with $G_{ij}$ is expressed as $G_{n-1}=(j-1)\times 2^{8-y}$.

2. The LCD of claim 1, wherein the data gray signal modifies the modification value $G_{ij}$ of the LUT so as to produce a modified modification value $G_{ij'}$ corresponding to a first value of the at least a modification parameter different from the reference value that satisfies:

$$G_{ij}'=G_{ij}+\alpha(G_{ij}-G_{ii})+\beta(G_{ij}-G_{ii})^2+\gamma(G_{ij}-G_{ii})^4+\ldots,$$

where $G_{ii}=(i-1)\times 2^{8-y}$, and $\alpha$, $\beta$, and $\gamma$ are modification coefficients compensating the difference between the first value and the reference.

3. The LCD of claim 2, wherein the data gray signal modifier sets the value of the modification coefficient to be greater than one when the first value is lower than the reference value, and sets the value of the modification coefficient to be less than one when the first value is higher than the reference value.

4. The LCD of claim 3, wherein the modification parameter is transmitted from the external device as a gray signal during a data blank period.

5. A method for driving a liquid crystal display (LCD), the LCD having a plurality of gate lines, a plurality of data lines insulated from and crossing the gate lines, and a plurality of pixels formed in an area surrounded by the gate lines and data lines and arranged as a matrix pattern arid having switching elements connected to the gate lines and data lines, the method comprising:

(a) sequentially supplying scanning signals to the gate lines;

(b) receiving image signals from an image signal source, and generating modification image signals from image signals of present and previous frames in accordance with one or more modification parameters; and (c) supplying data voltages corresponding to the generated modification image signals to the data lines, wherein the one or more modification parameters are at least one of a temperature, an image quality selected by a user, and an environment of the LCD, and wherein the generation of the modification image signals comprises:

selecting one of a plurality of conversion tables containing modification values matching with the previous frame image signal and the present image signal for different values of the one or more modification parameters, wherein the generation of modification image signals further comprises;

generating a new conversion table by converting the modification values of the selected conversion table according to a particular value of the one or more modification parameters, and generating the modification image signals based on the new conversion table.

6. The method of claim 5, wherein the image signals are identified as digital gray signals.

7. The method of claim 5, wherein the generation of the new conversion table is performed during a data blank period.

8. A liquid crystal display (LCD), comprising:

an LCD panel comprising a plurality of gate lines for transmitting scanning signals, a plurality of data lines that cross the gate lines for transmitting image signals, and a plurality of pixels that are arranged in a matrix and have switching elements connected to the gate lines and the data lines:

a data gray signal modifier that receives gray signals from an external device, and modifies gray signals of a present frame ("present gray signals) based on gray signals of present and previous frames and at least a modification parameter including a temperature, an image quality selected by a user, and an environment of the LCD;

a gate driver sequentially applying the scanning signals to the gate lines; and a data driver that converts the modified array signals into data voltages and applies the data voltages to the data lines, wherein the data gray signal modifier includes a storage device including a plurality of look-up tables (LUT) for different values of the at least a modification parameter, each LUT storing modification values for modifying gray signals, wherein the data array signal modifier further comprises:

an LUT selector selecting one of the plurality of LUT based on a value of the at least a modification parameter; and a modified signal generator that reads modification values corresponding to gray signals of present and previous frames from the selected LUT and generates the modified gray signals based on the modification values, wherein the LUT selector generates a coefficient value for converting modification values of the selected LUT based on a value of the at least a modification parameter, the data gray signal modifier further comprises an LUT converter converting modification values of the selected LUT based on the coefficient value to generate a modified LUT, and the modified signal generator reads modification values corresponding to gray signals of present and previous frames from the selected LUT or the modified LUT and generates the modified gray signals based upon the modification values.

9. The LCD of claim 8, wherein the data gray signal modifier modifies the gray signals so as to output a modification data voltage $V_n'$ that satisfies the following equation:

$$|V_n'|=|V_n|+f(|V_n|-|V_{n-1}|)$$

where the data voltage of the present frame is set to be $V_n$, and that of the previous frame is set to be $V_{n-i}$.

10. The LCD of claim 8, wherein the data gray signal modifier further comprises a frame memory for storing gray signals for one frame and outputs the stores gray signals as the gray signals of a previous frame ("previous gray signals").

11. The LCD of claim 10, further comprising a controller controlling writing and reading the gray signals of the frame memory.

12. The LCD of claim 11, wherein the controller operates in synchronization with a clock frequency of the gray signals inputted from the external device.

13. The LCD of claim 11, wherein the controller operates asynchronous from a clock frequency of the gray signals inputted from the external device.

14. The LCD of claim 13, wherein the LCD further comprises:

a combiner combining the gray signals to be synchronized with a clock signal frequency with which the controller is synchronized, and outputting the combined gray signals to the frame memory and the data gray signal converter; and a divider for dividing the gray signals output by the data gay signal modifier so as to be synchronized with a frequency with which the gray signals transmitted by the external device are synchronized.

15. A liquid crystal display (LCD), comprising:

an LCD panel comprising a plurality of gate lines for transmitting scanning signals, a plurality of data lines that cross the gate lines for transmitting image signals, and a plurality of pixels that are arranged in a matrix and have switching elements connected to the gate lines and the data lines;

a data gray signal modifier that receives a plurality of pairs of gray signals, each pair of gray signals including a gray signal of a present frame ("present gray signal") and a gray signal of a previous frame ("previous gray signal"), and modifies the present gray signals based on the pairs of gray signals and at least a modification parameter including a temperature, an image quality selected by a user, and an environment of the LCD;

a gate driver applying the scanning signals to the gate lines; and a data driver that converts the modified gray signals into data voltages and applies the data voltages to the data lines, wherein each of the present and the previous gray signals includes most significant bit (MSB) and least significant bit (LSB) and the data gray signal modifier includes at least a look-up table storing modification variables as function of pairs of MSBs of present and previous gray signals and a calculator generating the modified gray signals based on the modification variables and the LSB of the present gray signals, wherein the modification variables include first variable (f) related to each pair of MSBs and second and third variables (a and b) representing the difference between values of the first variable related to adjacent pairs of MSBs.

16. The LCD of claim 15, wherein the modified gray signal $G_n'$ for a present gray signal $G_n$ and a previous gray signal $G_{n-1}$ is given by, $$G_n' = f([G_n]_z, [G_{n-1}]_z) + a([G_n]_z, [G_{n-1}]_z)\cdot\frac{{}_y[G_n]}{2^z} - b([G_n]_z, [G_{n-1}]_z)\cdot\frac{{}_y[G_n]}{2^z}$$

where z is the bit number of the LSBs, $[G_n]_z$ represents the MSB of $G_n$, $[G_n]_z$ represents the MSB of $G_{n-1}$, and ${}_y[G_n]$ represents the LSB of $G_n$.

17. The LCD of claim 16, wherein a and b are positive integers.

18. A liquid crystal display (LCD), comprising:

an LCD panel comprising a plurality of gate lines for transmitting scanning signals, a plurality of data lines that cross the gate lines for transmitting image signals, and a plurality of pixels that are arranged in a matrix and have switching elements connected to the gate lines and the data lines:

a data gray signal modifier that receives a plurality of pairs of gray signals, each pair of gray signals including a gray signal of a present frame ("present gray signal") and a gray signal of a previous frame ("previous gray signal"), and modifies the present gray signals based on the pairs of gray signals and at least a modification parameter including a temperature, an image quality selected by a user, and an environment of the LCD;

a gate driver applying the scanning signals to the gate lines; and a data driver that converts the modified gray signals into data voltages and applies the data voltages to the data lines, wherein each of the present and the previous gray signals includes most significant bit (MSB) and least significant bit (LSB) and the data gray signal modifier includes at least a look-up table storing modification variables as function of pairs of MSBs of present and previous gray signals and a calculator generating the modified gray signals based on the modification variables and the LSB of the present gray signals, wherein the at least a look-up table includes a plurality of look-up tables (LUT) for different values of the at least a modification parameter, wherein the data gray signal modifier further comprises:

an LUT selector that selects one of the plurality of LUT and generates a coefficient value for converting modification variables of the selected LUT based on a value of the at least a modification parameter; and an LUT converter converting modification variables of the selected LUT based on the coefficient value to generate a modified LUT, and wherein the calculator calculates values of the modified gray signals from the modification variables corresponding to MSBs of present and previous gray signals from the selected LUT or the modified LUT and LSBs of the present gray signals, wherein the modification variables include a first variable (f) related to each pair of MSBs and second and third variables (a and b) representing the difference between values of the first variable related to adjacent pairs of MSBs.

19. The LCD of claim 18, wherein the modified gray signal $G_n'$ for a present gray signal $G_n$ and a previous gray signal $G_{n-1}$ is given by, $$G_n' = f([G_n]_z, [G_{n-1}]_z) + a([G_n]_z, [G_{n-1}]_z) \cdot \frac{y[G_n]}{2^z} - b([G_n]_z, [G_{n-1}]_z) \cdot \frac{y[G_n]}{2^z},$$

where z is the bit number of the LSBs, $[G_n]_z$ represents the MSB of $G_n$, $[G_n]_{z\ represents\ the\ MSB\ of\ Gn-1}$, and $y[G_n]$ represents the LSB of $G_n$.

20. The LCD of claim 19, wherein the converted second variable ($a_{ij}'$) of the second variable ($a_{ij}$) and the converted third variable ($b_{ij}'$) of the third variable ($b_{ij}$) satisfy the following equations:

$$a_{ij} = G_{i+1,j} - G_{ij},$$

$$a_{ij}' = G_{i+1,j}' - G_{ij}',$$

$$= [G_{i+1,i+1} + \alpha(G_{i+1,j} - G_{i+1,j+1}) + \beta(G_{i+1,j} - G_{i+1,j+1})^2 + \dots ]$$

$$= -[G_{ii} + \alpha[G_{ij} - G_{ii}) + \beta(G_{ij} - G_{ii})^2 + \dots ]$$

$$= 2^{8-y} + \alpha(a_{ij} - 2^{8-y}) + \beta(a_{ij} - 2^{8-y}) \times \{a_{ij} - 2^{8-y} + 2(G_{ij} - G_{ii})\}^2 + \dots ,$$

$$b_{ij} = G_{i,j+1} - G_{ij}, \text{ and}$$

$$b_{ij}' = G_{i,j+1}' - G_{ij}',$$

$$= [G_{ij} + \alpha(G_{i,j+1} - G_{ii}) + \beta(G_{i,j+1} - G_{ii})^2 + \dots ] - [G_{ii} + \alpha(G_{ij} - G_{ii}) + \beta(G_{ij} - G_{ii})^2 + \dots ]$$

$$= \alpha b_{ij} + \beta b_{ij}\{b_{ij} + 2(G_{ij} - G_{ii})\}^2 + \dots$$

* * * * *